US006164640A

United States Patent [19]

Stengl et al.

[11] Patent Number: 6,164,640

[45] Date of Patent: Dec. 26, 2000

[54] APPARATUS FOR DIRECTIONALLY REORIENTING SHEETS

[75] Inventors: Richard F Stengl, Wolcott; Joseph F Zuzick, Jr., Naugatuck; Edward M Ifkovits, New Fairfield, all of Conn.

[73] Assignee: Pitney Bowes Inc., Stamford, Conn.

[21] Appl. No.: 08/841,875

[22] Filed: May 5, 1997

[51] Int. Cl.[7] ..... B65H 29/00

[52] U.S. Cl. ..... 271/187; 271/189; 271/225

[58] Field of Search ..... 271/225, 273, 271/245, 246, 184, 189

[56] References Cited

U.S. PATENT DOCUMENTS

| | | | |
|---|---|---|---|
| 4,879,571 | 11/1989 | Plasscheart | 271/225 |
| 4,909,374 | 3/1990 | Skrypalle | 271/225 |
| 5,205,551 | 4/1993 | Nagano et al. | 271/225 |
| 5,253,861 | 10/1993 | Schmaling | 271/245 |
| 5,538,241 | 7/1996 | Auerbach et al. | 271/225 |
| 5,641,158 | 6/1997 | Gelb, Jr. et al. | 271/225 |
| 5,649,698 | 6/1997 | Auerbach et al. | 271/225 |
| 5,653,438 | 8/1997 | Crowley et al. | 271/225 |
| 5,810,346 | 9/1998 | Jorg | 271/225 |
| 5,833,232 | 11/1998 | Ifkovits et al. | 271/225 |

*Primary Examiner*—Donald P. Walsh
*Assistant Examiner*—D K Schlak
*Attorney, Agent, or Firm*—Christopher J. Capelli; Michael E. Melton

[57] ABSTRACT

The present invention provides an apparatus and method for receiving at least one sheet from a first upstream direction and feeding the at least one sheet in either a second mainstream direction or a third disposal direction. Conventionally, this invention may be used to reorient a sheet, or an accumulation of sheets, from landscape to portrait or vice versa, and to dispose of an incorrect accumulation of sheets into an out-sort station.

2 Claims, 7 Drawing Sheets

APPARATUS FOR DIRECTIONALLY REORIENTING SHEETS

FIELD OF THE INVENTION

The present invention relates generally to multi-station document inserting systems which assemble batches of documents for insertion into envelopes. More particularly, the present invention is directed toward an apparatus and method for receiving sheets from a first direction and re-orienting the direction of feed of the sheets into either a second or third direction.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc., Stamford, Conn.

In many respects the typical inserter system resembles a manufacturing assembly line. Sheets and other raw materials (other sheets, enclosures, envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, an insert station, a plurality of insert feeder stations and a burster-folder station. There is a computer generated form or web feeder that feeds continuous form control documents having control coded marks printed thereon to the burster-folder station for separating and folding. The control marks on the control documents are sensed by a control scanner located in the burster-folder station. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes

- a control system to synchronize the operation of the overall inserter system to ensure that the collations are properly assembled.

Devices are known which turn collation of sheets within a plane. These devices are often utilized in inserter systems to change the orientation of the sheets (for example, landscape to portrait and vice versa) so as to facilitate further downstream processing. Another application for turning devices is in merging sheets from a first stream of sheets into a second stream of sheets. Examples of turning devices utilized in inserter systems are shown in U.S. Pat. Nos.: 4,909,374; 5,180,154; 5,180,159; 5,188,355; and 5,413,326; all of which are assigned to the assignee of the present invention. Such devices are commonly referred to as a transfer module.

A typical transfer module receives a sheet or sheets from an input machine disposed in a lateral direction, stops its movement, and then feeds it out in the longitudinal direction of the mainstream feed path. Thus, the transfer module changes the orientation of each sheet from a landscape to portrait orientation, or vice versa. Specific application of transfer modules is that they may be adapted to receive an accumulation of sheets from an upstream module along a lateral direction and then advance the accumulation of sheets along a longitudinal direction in the mainstream feed path. Additionally, transfer modules can be adapted to perform the sheet accumulation in the transfer module itself. Regardless of whether the sheet accumulation is performed in the transfer module or in an upstream accumulation module thereof, occasionally, the accumulation of sheets will be incorrect, as detected by the control system. In the event there is an incorrect accumulation, conveyance of this accumulation may have deleterious effects in the inserter modules disposed along the mainstream path located downstream of the transfer module.

Therefore, it is an object of the present invention to provide a transfer module that is adapted to dispose an incorrect accumulation of sheets into an out-sort station for disposal thereof.

SUMMARY OF THE INVENTION

The present invention provides an apparatus and method for receiving at least one sheet from a first upstream direction and feeding the at least one sheet in either a second mainstream direction or a third disposal direction. Conventionally, this invention may be used to reorient a sheet, or an accumulation of sheets, from landscape to portrait or vice versa, and to dispose of an incorrect accumulation of sheets into an out-sort station.

In accordance with the present invention, the apparatus includes:

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
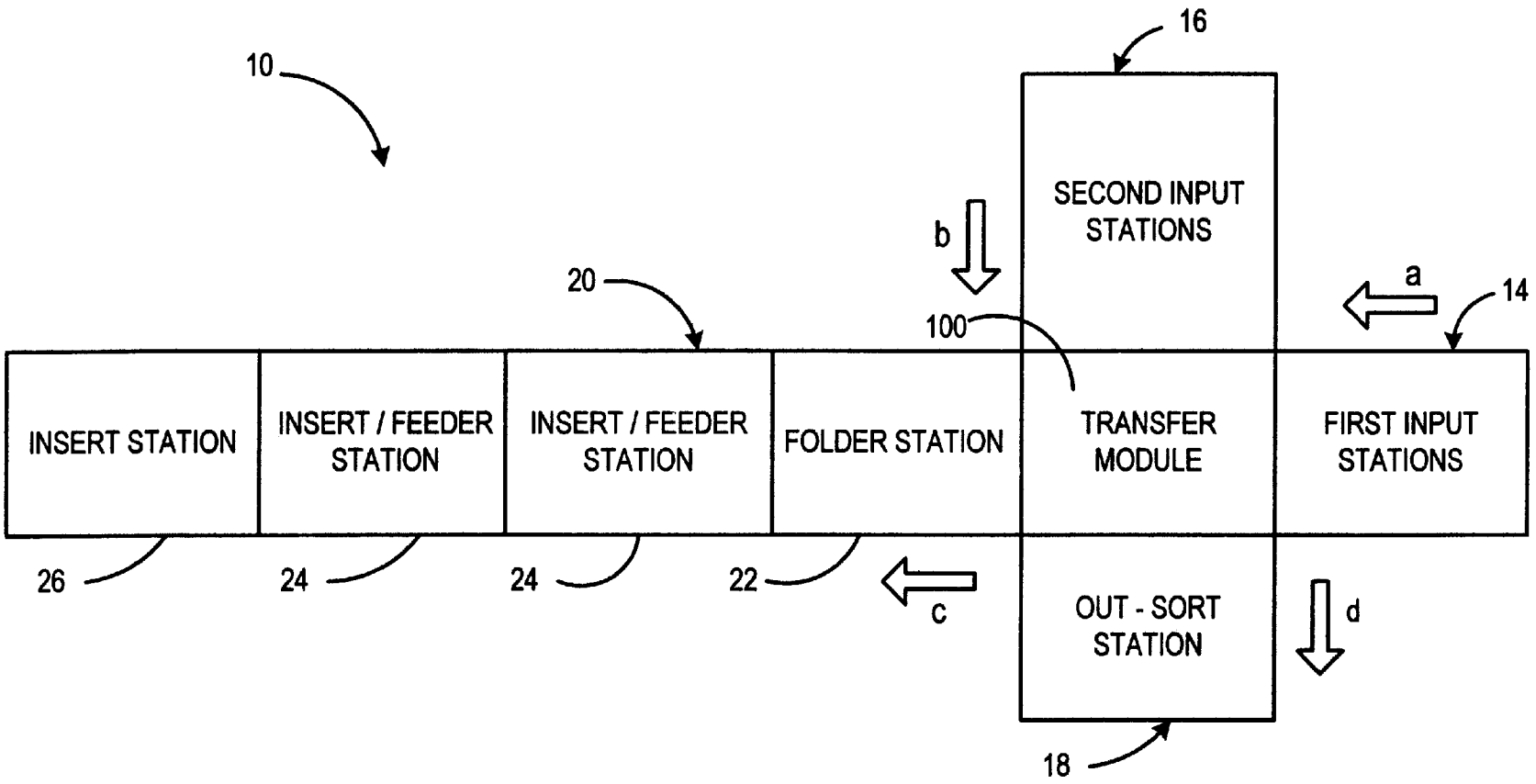
FIG. 1 is a schematic of a mailing machine in which the present invention is incorporated.
Figure 2:
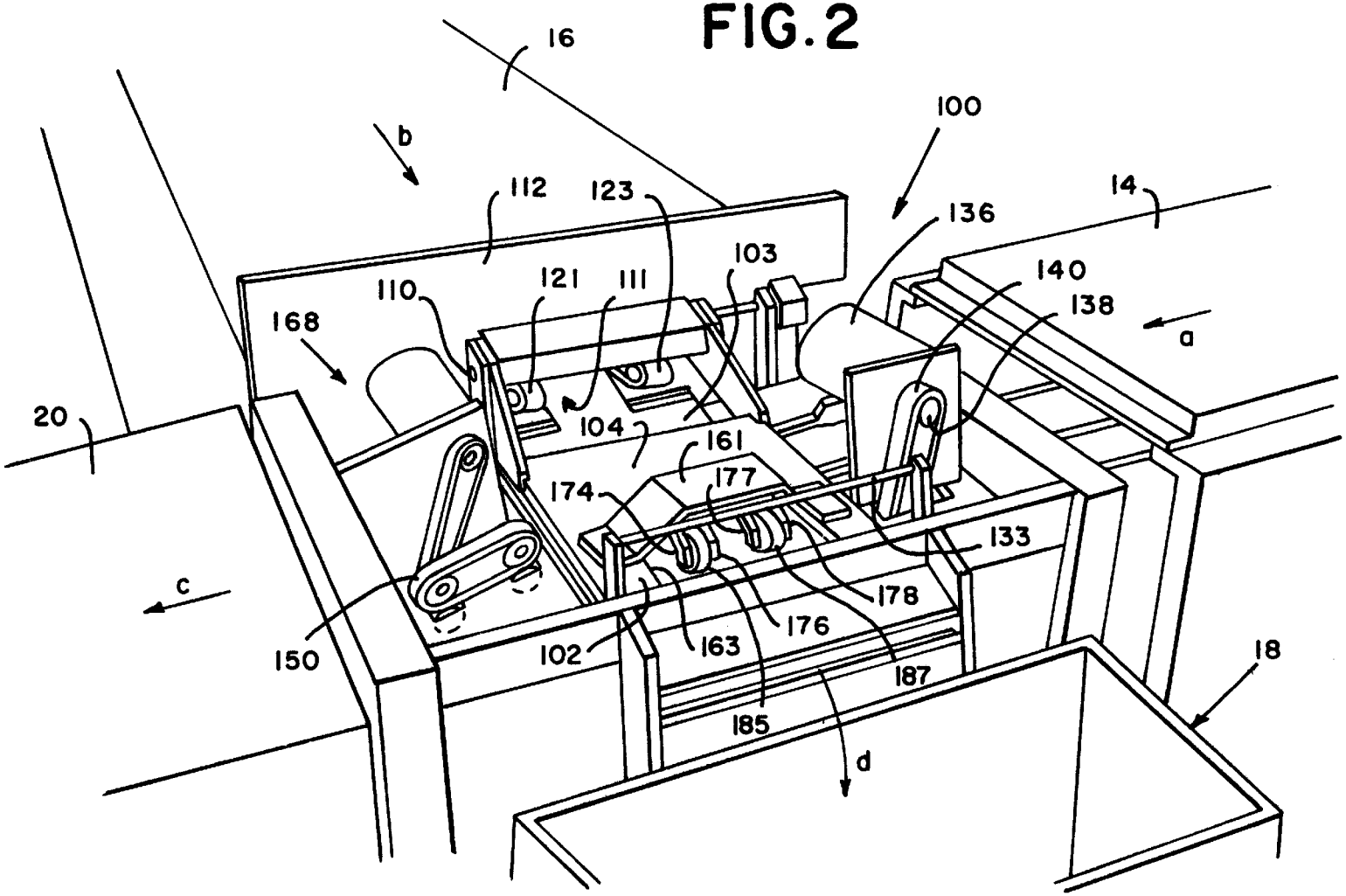
FIG. 2 is a perspective view of an embodiment of the present invention transfer module implemented in the mailing machine of FIG. 1 that receives at least one sheet from a first paper direction and conveys the at least one sheet in either a second or third paper direction.

In describing the preferred embodiment of the present invention, reference is made to the drawings, wherein there is seen in FIG. 1 a schematic of a typical document inserting system, generally designated 10, which implements the present invention transfer module 100. System 10 preferably includes a series of first input stations 14 and a series of second input stations 16 connected to the transfer module 100. It is to be appreciated that such input stations consist of well known devices such as, but not limited to, a sheet burster, a cut sheet feeder, a sheet transporter, etc. Essentially, the first input stations 14 feed sheets along a first paper direction, as indicated by arrow "a," onto the main deck 105 of the transfer module 100, as will be described below. And the second input stations 16 feed sheets 50 along a second paper direction, as indicated by arrow "b," onto the elevated deck 103 of the transfer module 100, as will also be described below.

The transfer module 100 is also connected to a series of output stations 20, which define a third paper direction, as indicated by arrow "c," and to an out-sort station 18, which defines a fourth paper direction, as indicated by arrow "d." As shown in FIG. 1, the output stations 20 consists of well known devices such as, but not limited to, a folder station 22, a series of connected insert/feeder stations 24, an envelope insert station 26, etc. It is to be appreciated that since the first input station 14, the second input stations 16, and the output stations 20 form no part of the present invention, they will not be further shown or described herein except to the extent necessary for an understanding of the present invention transfer module 100.

Regarding the out-sort station 18, it is to be understood to consist of any known type of device that is capable of collecting sheets conveyed from the transfer module 100 (e.g.,. a collection bin), via the fourth paper direction (as indicated by arrow d). Moreover, it is to be appreciated that the out-sort station 18 is not to be understood to only be limited to a sheet collection apparatus but rather may conceivably consist of a second series of output stations, similar to the output stations 20 disposed in the third paper path (as indicated by arrow c). Thus, the present invention transfer module 100 may provide a means for coupling two input stations with two output stations. Further, as used herein, the term sheet refers to: a single sheet, a plurality of sheets, a booklet, a folded plurality of sheets or any other type of collation configuration.

As will be described further below, the transfer module 100 is operative to either convey the sheets being fed from second input stations 16, via the second paper direction (as indicated by arrow b), into either the third paper direction (as indicated by arrow c) to the output stations 20 or into the fourth paper direction (as indicated by arrow d) to the out-sort station 18. In the present exemplary embodiment, the transfer module 100 does not effect the sheets being fed from the first input station 14, via the first paper direction (as indicated by arrow a). That is, the sheets being fed in the first paper direction (as indicated by arrow a) from the first input station 14 are conveyed directly through the transfer module 100 via its main paper deck 105, and into the third paper direction (as indicated by arrow c) of the output stations 20. The transfer module 100 in accordance with the present invention will now be described below.

Referring now to FIGS. 2–5, the present invention transfer module 100 includes a lower deck plate 102, an upper deck plate 104, a first transport assembly 106 and a second transport assembly 108. The transfer module 100 is configured to provide an elevated paper deck 103 and a main paper deck 105 in the document inserting system 10. The elevated paper deck 103 is defined between the bottom surface of the upper deck plate 104 and the top surface of the lower deck plate 102 and receives sheets 50 in the second paper direction (as indicated by arrow b) from the second input stations 16. As will be further described below, sheets 50 transported onto the elevated paper deck 103 are conveyed into either the third paper direction (as indicated by arrow c) to the output stations 20, via the first transport assembly 106, or into the fourth paper direction (as indicated by arrow d) to the out-sort station 18, via the second transport assembly 108.

Regarding the main paper deck 105 of the transfer module 100, it is defined below the elevated paper deck 103 and receives sheets in the first paper direction (as indicated by arrow a) from the first input stations 14, and conveys the sheets directly in the third paper direction (as indicated by arrow c) to the output stations 20. As is known in the art, the main paper deck 105 is provided in the "chassis" of the inserter system 10. A transporter means (e.g., a conveyer belt) (not shown) is preferably provided in the main paper deck 105 so as to convey the sheets from the first input station 14 in the third paper direction (as indicated by arrow c) to the output stations 20.

Figure 3:
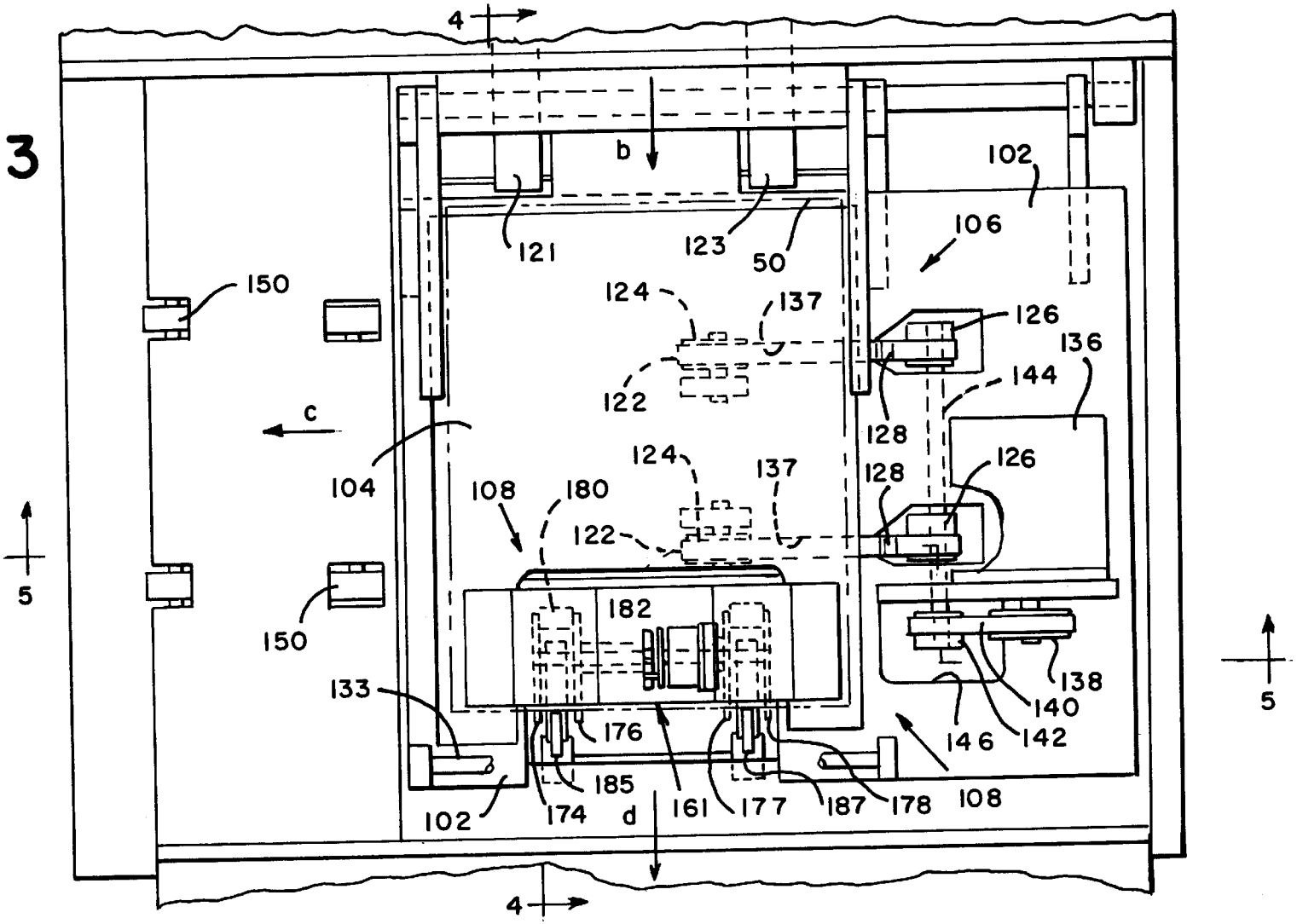
FIG. 3 is a planar view of the transfer module shown in FIG. 2.

As best shown in FIG. 3, the lower and upper deck plates 102 and 104 are both pivotally mounted to a common shaft 110 which extends from and is fixably mounted to a side wall 112 of the transfer module 100. The lower and upper deck plates 102 and 104 pivot independent of one another about shaft 1 10. Preferably, the lower deck plate 102 is provided with a handle member 133 for enabling a user to pivot the lower and upper deck plates 102 and 104, respectively. It is to be understood that the upper deck plate 104 can be caused to pivot upwards relative to the lower deck plate 102, and when the lower deck plate 102 is caused to pivot upwards, it must pivot along with the upper deck plate 104 since the upper deck plate 104 rests upon the lower deck plate 102. Gravity tends to maintain the upper deck plate 104 in a closed position atop the lower deck plate 102. Further, spacing members 125 are provided on the upper deck plate 104 so as to maintain a proper gap between the lower deck plate 102 and the upper deck plate 104 in order to receive sheets 50 on the elevated deck 103 of the transfer module 100. It is important to note that the spacing members 125 are located outside of the paper path of the elevated deck 103 so as not to interfere with the sheets 50 as they enter and exit from the elevated deck 103 of the transfer module 100.

It is noted that an advantage of upwardly pivoting the upper deck plate 104 is that a user can gain access to the top surface of the lower deck plate 102 (i.e., the elevated paper deck 103). And an advantage of upwardly pivoting the lower deck plate 102 is that a user can gain access to the main paper deck 105 of the transfer module 100. This can be particularly advantageous in the situation when a user has to clear a paper jam occurring on either the elevated paper deck 103 or the main paper deck 105 of the transfer module 100.

The transfer module 100 also preferably includes an entrance station 111 that is operative to receive sheets 50 in the second paper direction (as indicated by arrow b) from the second input stations 16 and convey those sheets 50 onto the elevated deck 103 of the transfer module 100. The entrance assembly 111 is provided on the side wall 112 of the transfer module 100 that is adjacent to the second input stations 16. The entrance station 111 preferably includes a pair of pinch rollers 113 and 115 and a pair of pulleys 117 and 119 around which extends a respective drive belt 121 and 123. A drive assembly (not shown) causes the drive belts 121 and 123 and pulleys 117 and 119 to rotate in a counterclockwise direction so as to convey the sheets 50 from the second input stations 16 to the elevated deck 103 of the transfer module 100.

The first transport assembly 106 is provided on the lower deck plate 102 and is operative to convey sheets 50 from the elevated paper deck 103 of the transfer module 100 into the third paper direction (as indicated by arrow c) to the output stations 20. Thus, the first transport assembly 106 causes the sheets 50 to enter into the transfer module 100 in a portrait orientation and exit therefrom into the output stations 20 in a landscape orientation, or vice versa. The first transport assembly 106 includes a pusher finger transport assembly 120 and a take-away transport assembly 130. The pusher finger transport assembly 120 includes a pair of endless belts 122 extending around respective sets of pulleys 124 and 126. The belts 122 run beneath the lower deck plate 102 and each include a pusher finger 128 which rises and falls below the lower deck plate 102 as the belts 122 rotate. Each pusher finger 128 extends through a respective cut out 137 provided in the lower deck plate 102. As best shown in FIG. 3, each cut out 137 has a first side 132 which is beveled upwards and a second side 134 which is beveled downwards so as to guide the leading edge of the sheets 50 being conveyed into the transfer module 100 over (and not into) each cut out 137.

The pusher finger transport assembly 120 also includes a motor 136 that is preferably mounted to the lower deck plate 102. The motor 136 includes a pulley 138 around which an endless drive belt 140 extends. The endless drive belt 140 also extends around a pulley 142 that is mounted below the lower deck 102 and is in coaxial alignment with pulleys 126. As best shown in FIG. 3, the lower deck plate 102 provides a cut out 146 through which extends the drive belt 140 so to extend around pulley 142. A common shaft 144 extends through both pulley 142 and pulleys 126. Thus, counterclockwise rotation of motor 136 causes counterclockwise rotation of drive belt 140, which in turn causes counterclockwise rotation of belts 122, via pulleys 126 and 142, causing corresponding rotation of pusher fingers 128. It is to be appreciated that one cycle of motor 136 causes a complete cycle rotation of pusher fingers 128.

The take-away transport assembly 130 is operative to receive the leading edge of the sheets 50 being fed by the pusher fingers 128 and to convey those sheets 50 into the third paper direction (as indicated by arrow c) to the output stations 20. The take-away transport assembly 130 includes a pair of endless belts 150 extending around a respective sets of pulleys 152 and 154. Biasing against the endless belts 150 are respective sets of normal force rollers 156 and 158. Common shafts 160 and 162 respectively extend through pulleys 152 and 154, and common shafts 164 and 166 respectively extend through normal force rollers 156 and 158. Shaft 160 is operatively coupled to a drive system 168 (shown in phantom) for causing shaft 160 to rotate to provide the necessary input drive for causing the belts 150 to rotate in a clockwise direction so as to convey sheets 50 in the third paper direction (as indicated by arrow c) to the output stations 20.

The second transport assembly 108 includes a document registration apparatus 161 which aligns (registers) the edges of the sheets 50 on the lower deck plate 102 (i.e., the elevated paper deck 103) of the transfer module 100. The document registration apparatus 161 is preferably mounted on the top surface of the upper deck plate 104. As best shown in FIG. 3, the document registration apparatus 161 is substantially mounted over a cut out 163 provided on the upper deck plate 104 such that its below described mechanisms may extend through the cut out 163 operatively and towards the lower deck plate 102. It is to be appreciated that document registration apparatus' are well known in the art and thus apparatus 160 will not be described in detail herein except to the extent necessary to understand its implementation in the present invention transfer module 100. For example, U.S. Pat. Nos. 5,253,861, 5,255,906 and 5,263,705 which are each commonly assigned to the assignee of the present invention and are hereby incorporated by reference, each describe a document registration apparatus.

Figure 4:
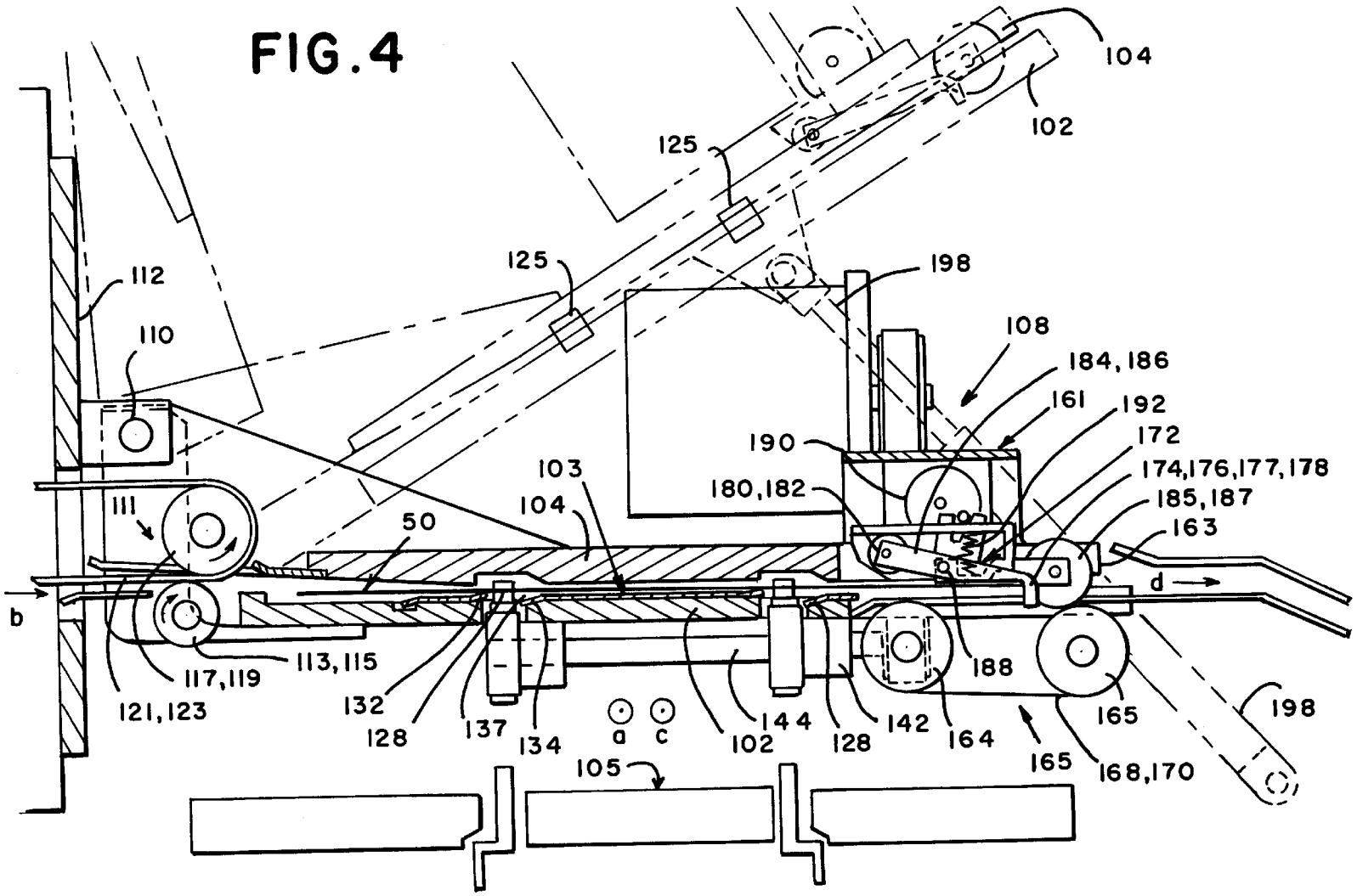
FIG. 4 is a cross-sectional view taken along line A—A of FIG. 3.

Also included in the second transport assembly 108 is a document conveyor system 165 preferably consisting of a respective set of rollers 164 and 166 around which an endless belt 168 and 170 extends around, respectively. As will be described below, the document conveyor system 165 is operative to convey sheets 50 from the transfer module 100 to the out-sort station 18 in the fourth paper direction (as indicated by arrow d). As best shown in FIG. 4, the document conveyor system 165 is positioned such that the top sides of the endless belts 168 and 170 are disposed in a plane which is lower than that of the top side of the lower deck plate 102. Thus overlapping sheets 50 that are disposed on the lower deck plate 102 will therefore not ordinarily contact the conveyor system 162 unless the document registration apparatus 165 causes such contact, as will be described further below.

The document registration apparatus 161 includes a pivoting registration unit 172 that includes four registration stops 174, 176, 177 and 178 on the downstream end and two non driver urge rollers 180 and 182 on urge roller arms 184 and 186, respectively, on the upstream end of the unit 172. Non driver urge rollers 180 and 182 are preferably spaced at lateral positions between the lateral positions of registration stops 174 and 176 on the one hand, and the lateral positions of registration stops 177 and 178 on the other hand, respectively (see FIG. 3). The registration unit 172 pivots around pivot axis 188. A rotary solenoid 190 is linked to an actuating assembly 192 that causes unit 172 to pivot about axis 188 upon actuation of the solenoid 190.

In a normal rest position, the registration unit 172 is maintained in a closed position wherein the four registration stops 174, 176, 177 and 178 are biased downward against the top surface of the lower plate deck 102. In this position, the four registration stops 174, 176, 177 and 178 function to stop and align the sheets 50 being fed into the elevated deck 103 of the transfer module 100 from the second paper direction (as indicated by arrow b) of the second input stations 16. Further, it is to be appreciated that when the four registration stops 174, 176, 177 and 178 are in the downward biased position (as shown in FIG. 4), the transfer module 100 can accumulate the sheets 50 being fed from the second input stations 16 before the sheets 50 are conveyed in either the third paper direction (as indicated by arrow c) to the output stations 20 or in the fourth paper direction (as indicated by arrow d) to the out-sort station 18.

In the event the sheets 50, or the accumulation of sheets 50, are determined not to be conveyed into the output stations 20 by the aforementioned first transport assembly 106, the rotary solenoid 190 is momentarily energized which causes pivoting movement of the registration unit 172 causing the four registration stops 174, 176, 177 and 178 to bias upwards away from the lower deck plate 102 and the two non driver urge rollers 180 and 182 to bias downward towards the document conveyor system 165 to urge the overlapping sheets 50 against the rotating conveyor belts 168 and 170. Once the sheets 50 are caused to contact the conveyor belts 168 and 170, they advance through the nips formed between the exit pinch rollers 185 and 187 and the belts 168 and 170 so as to be conveyed in the fourth paper direction (as indicated by arrow d) to the out-sort station 18.

Figure 5:
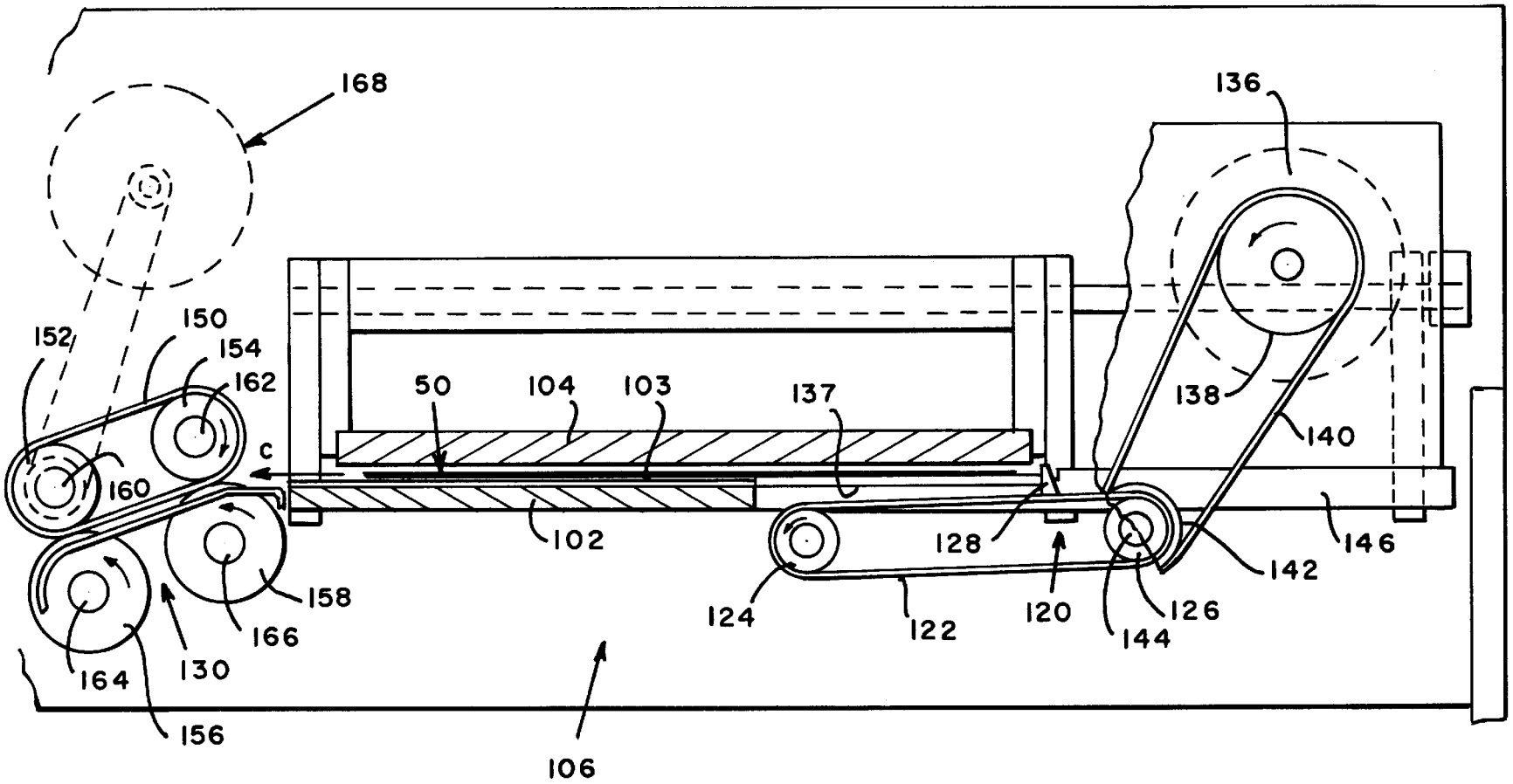
FIG. 5 is a cross-sectional view taken along line B—B of FIG. 3.

Referring now to FIG. 5, a control system 200 is provided that is in communication with the first and second transport assemblies 106 and 108. The control system 200 may be of any suitable combination of hardware and software so as to accomplish its function of controlling the operation of the transfer module 100. The control system 200 includes various sensors (not shown) located throughout the inserter system 10, which each provide an indication to the control system 200 concerning the progress of the sheets that are located in various modular components of the system (e.g., the presence or absence of sheets in a particular modular component). Based upon the status of each of its sensors, the control system 200, among other things, selectively energizes either the pusher finger transport assembly 120 (more specifically, the motor 136) of the first transport assembly 106, or the document registration apparatus 161 (more specifically, the rotary solenoid 190) of the second transport assembly 108.

Figure 6:
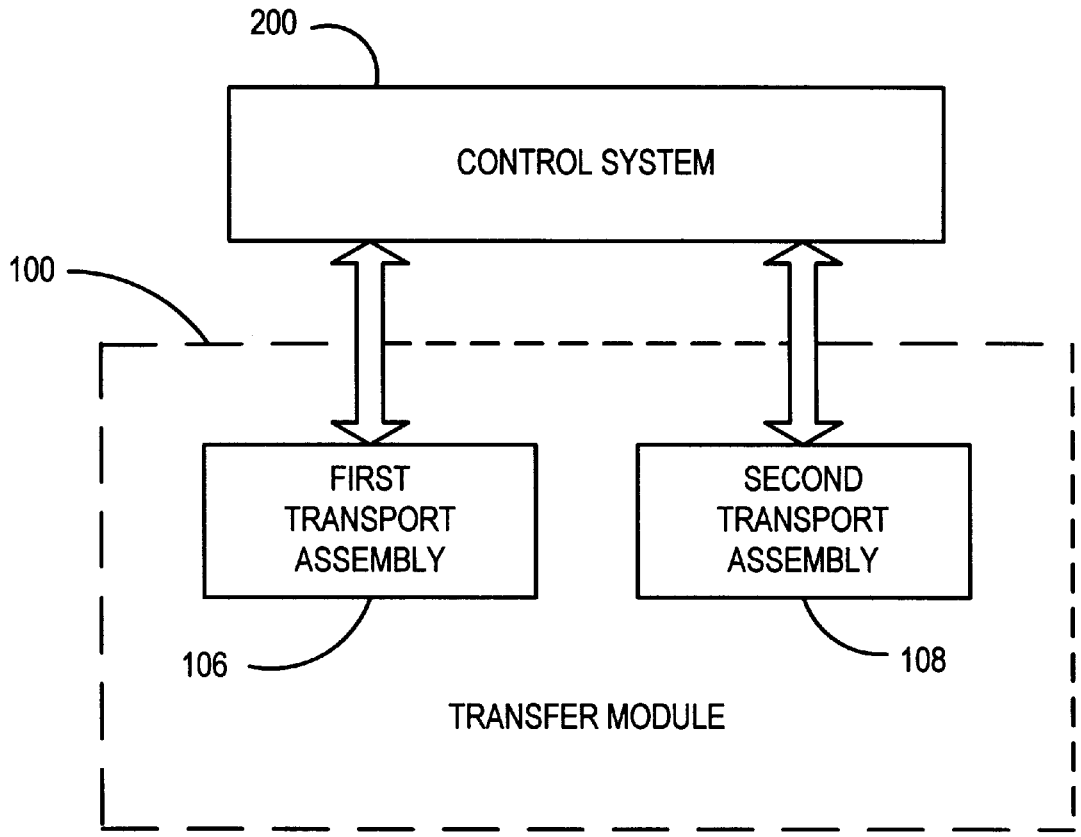
FIG. 6 is a schematic diagram of the major operating control components of the mailing machine of FIG. 1.
Figure 7:
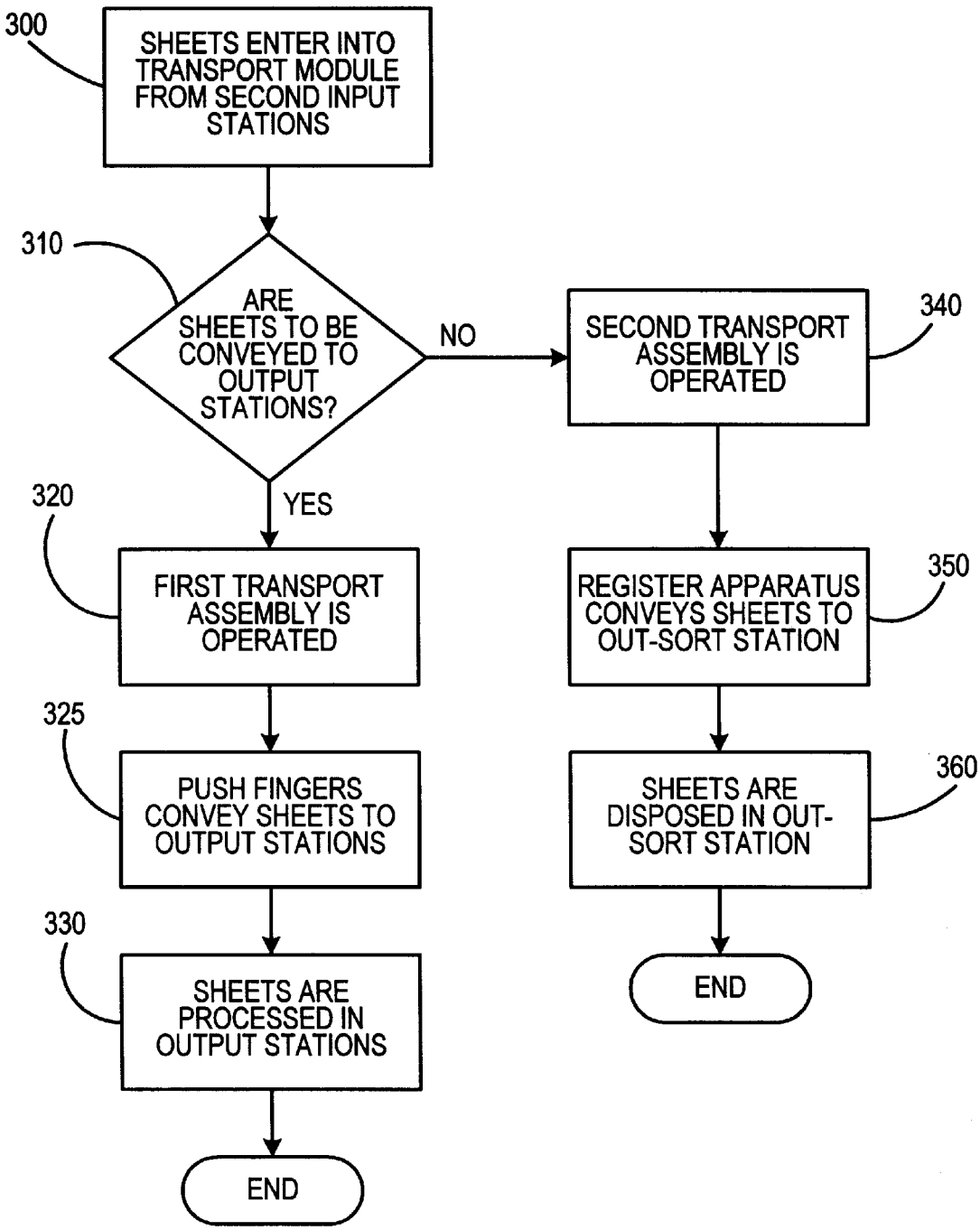
FIG. 7 is a flow chart depicting the operation process for the transfer module of FIG. 2.

In summary and with reference to FIG. 6, which depicts the operation process of the transfer module 100, sheets 50 are caused to enter convey in the second paper path (as indicated by arrow b) and into the transfer module 100 from the second input stations 16 (step 300). The entrance station 111 of the transfer module 100 facilitates the conveyance of the sheets 50 from the second input stations 16 to the elevated deck 103 of the transfer module 100. A determination is then made by the control system 200 as to whether the sheets 50 disposed on the elevated deck 103 of the transfer module 100 are to be conveyed to either the output stations 20, via the third paper direction (as indicated by arrow c) or to the out-sort station 18, via the fourth paper direction (as indicated by arrow d) (step 310).

If the control system 200 determines to convey the sheets 50 to the output station 20 (so as to possibly merge with the sheets being conveyed along the main deck 105 from the first paper direction (as indicated by arrow a) (of the first input stations 14), the motor 136 of first pusher finger transport assembly 106 is caused to energize for a single cycle (step 320). A single cycle energizing of the motor 136 causes the pusher fingers 128 to advance from their rest position and rise above the lower deck plate 102 and contact the sheets 50 disposed on the elevated deck 103 so as to convey the sheets 50 into the third paper direction (as indicated by arrow c) toward the output stations 20. The leading edges of the sheets 50 then enters into the take-away assembly 130, which assumes control of the sheets 50 and preferably advances the sheets 50 ahead of the pusher fingers 128 before the pusher fingers 128 fall below the lower deck plate 102. The take-away assembly 130 continues to convey the sheets 50 out of the transfer module 100 and toward the output stations 20 in the third paper direction (as indicated by arrow c). The sheets 50 are thereafter conveyed into the output station 20 for processing therein and the pusher fingers 128 are advanced to and maintained in their rest position until further instructions from the control system 200 (step 330).

Returning to step 310, if the control system 200 determines that the sheets 50 disposed on the elevated deck 103 of the transfer module 100 are not to be conveyed to the output stations 20, but rather are to be conveyed into the out-sort station 18, the rotary solenoid 190 of the second transport assembly 108 is caused to be energized (step 340). Once the rotary solenoid 190 is energized, the four registration stops 174, 176, 177 and 178 pivot away from the elevated deck 103 and the two non-driver rollers 180 and 182 pivot downward towards the elevated deck 103 so as to urge the sheets 50 against the continuously running out-sort conveyor belts 168 and 170. The out-sort conveyor belts 168 and 170 then convey the sheets 50 from the elevated deck 103 of the transfer module 100 in the fourth paper direction (as indicated by arrow d) to the out-sort station 18 (step 350). Once in the out-sort station 18, the sheets may then be disposed (step 360). The rotary solenoid 190 is then caused to be de-energized affecting the two non-driver rollers 180 and 182 to pivot upward and away from the elevated deck 103 and the four registration stops 174, 176, 177 and 178 to pivot downward and towards the elevated deck 103 of the transfer module 100. Thus, the four registration stops 174, 176, 177 and 178 now cooperatively function to stop and register the sheets 50 being fed from the second input station 16 until further instructions from the control system 200 as to whether these sheets are to be conveyed to the output stations 20, via the first transport assembly 106, or the out-sort station 18, via the second transport assembly 108. Thus, repetition of the above-described process of FIG. 3 is once again performed.

In conclusion, a transfer module has been shown and described which is configured to selectively convey sheets to either an output station for further processing or to an out-sort station, preferably for removal thereof. Although the invention has been described with emphasis on a particular embodiment, it should be understood that the figures are for illustration of exemplary embodiments of the invention and should not be taken as limitations or thought to be the only means of carrying out the invention. Further, it is contemplated that many changes and modifications may be made to the invention without departing from the scope and spirit of the invention as disclosed.

What is claimed is:

1. A method for conveying sheets received from first and second input sources to a paper deck of a document inserting system, comprising the steps of:

providing an apparatus having a first paper path coupled to the first input source and a second paper path coupled to the second input source, the apparatus having an output connected to the paper deck of the inserter system;

receiving sheets conveying from the first input source in the first paper path of the apparatus;

continuously conveying the sheets in the first paper path of the apparatus to the paper deck of the inserter system;

receiving individual sheets conveying in a first direction and in a first paper orientation from the second input source in the second paper path of the apparatus;

accumulating a predetermined number of sheets in the second paper path of the apparatus; and conveying the accumulated sheets in the second paper path of the apparatus to the paper deck of the inserter system in a second direction that is substantially orthogonal relative to the first direction.

2. A method as recited in claim 1 including the steps of:

providing a second output source coupled to the second paper path of the apparatus;

conveying the accumulated sheets on the second paper path of the apparatus to the second output source upon command from the inserter system.

* * * * *